US005203238A

United States Patent [19]

Ferguson

[11] Patent Number: 5,203,238

[45] Date of Patent: Apr. 20, 1993

[54] LOW PROFILE RACK AND PINION WRENCH

[75] Inventor: John H. Ferguson, Rocky Hill, Conn.

[73] Assignee: Raymond Engineering Inc., Middletown, Conn.

[21] Appl. No.: 428,298

[22] Filed: Oct. 27, 1989

[51] Int. Cl.[5] ..... B25B 13/06

[52] U.S. Cl. ..... 81/57.39

[58] Field of Search ..... 81/57.39, 185

[56] References Cited

U.S. PATENT DOCUMENTS

| | | | |
|---|---|---|---|
| 759,948 | 5/1904 | Weston . | |
| 1,564,222 | 12/1925 | Dunlap | 81/185 |
| 3,448,641 | 6/1969 | Morrow . | |
| 4,116,093 | 9/1978 | De Pagter | 81/57.39 |
| 4,631,990 | 12/1986 | Hughes . | |
| 4,671,142 | 6/1987 | Junkers . | |
| 4,722,252 | 2/1988 | Fulcher et al. | 81/57.39 |
| 4,825,730 | 5/1989 | Junkers | 81/57.39 |

FOREIGN PATENT DOCUMENTS

| | | |
|---|---|---|
| 0153711 | 4/1985 | European Pat. Off. . |
| 0179543 | 4/1986 | European Pat. Off. . |
| 0240012 | 2/1987 | European Pat. Off. . |
| 8503897 | 9/1985 | PCT Int'l Appl. . |
| 8702610 | 5/1987 | PCT Int'l Appl. . |
| 2028204 | 3/1980 | United Kingdom . |

*Primary Examiner*—James G. Smith
*Attorney, Agent, or Firm*—Fishman, Dionne & Cantor

[57] ABSTRACT

A fluid operated low profile wrench has a rack and gear drive system to provide an accurate lever arm. The gear is a gear segment which forms part of the output lever of the wrench. The wrench is capable of using a multiplicity of drive heads and/or a multiplicity of reaction elements.

28 Claims, 4 Drawing Sheets

LOW PROFILE RACK AND PINION WRENCH

BACKGROUND OF THE INVENTION

This invention relates to fluid operated torque wrenches. More particularly, this invention relates to low profile or "in line" torque wrenches which are usable in environments where access to fastener elements to be torqued (e.g., a bolt head) and to a ground element for reaction (e.g., an adjacent bolt head) is limited.

Fluid operated torque wrenches of the type under consideration usually have a fluid powered piston rod drivingly connected to an output lever as the operating mechanism of the wrench; and the output lever typically has a ratchet mechanism about an output socket to permit the wrench to be stroked in forward and return directions without removing the wrench from the bolt. The output lever arm travels in a circular arc about the axis of the output socket, and the connection between the piston rod and the output lever has to be able to accommodate relative movement between the piston rod and the output lever to allow for the arcuate movement of the lever arm. As a result, the effective lever arm of the wrench and the angle or direction at which the force is applied from the piston rod to the lever arm changes throughout the stroke of the piston. This impairs the accuracy of the torquing operation of the wrench.

SUMMARY OF THE INVENTION

In addition to other features and advantages, the wrench of the present invention has a drive mechanism in which both the effective lever arm and the point, angle and direction of application of force to the lever arm remain effectively constant throughout the operating stroke of the wrench. This effective constancy is achieved through the use of a rack and gear segment operating mechanism. The piston rod is connected to and drives a rack which constitutes an extension of the piston rod; and the teeth of the rack mesh with a gear segment on the output lever. The rack travels in a track in the body of the wrench. The pitch line of the rack is an extension of the axis of the piston rod, and the pitch point of the system (i.e., the point of intersection of the pitch line of the rack and the pitch line of the gear segment) and the axis of rotation of the output lever are on a line that is at 90° to the axis of the piston rod on the forward (i.e., operating) direction of the wrench. This rack and gear structure results in a constant effective lever arm length and a constant effective 90° angle and direction of application of force to the lever arm.

For low profile application, the output head of the wrench (which includes the gear segment, the ratchet and pawl mechanism and a hexagonal opening for bolt head engagement) can be detached easily from the wrench and replaced with a head having a different size hexagonal opening. A positioning finger system insures that the gear segment of the replacement head is installed with the gear teeth of the segment in proper mesh with the gears of the rack.

An in-line reaction foot attached to the body of the wrench provides a reaction element for reaction against an adjacent bolt head or other coplanar grounding element.

If access to the fastener to be torqued is not limited, the wrench can be used in an "offset" mode without the need to change the head of the wrench, merely by the use of a hex-to-square drive bar adapter. The hex end of the adapter is inserted in the hexagonal opening of the wrench head so that the square drive bar projects perpendicularly from the head. An assortment of sockets can then be attached to and used with the square drive bar.

If necessary or desirable, an offset reaction element can also be attached to and used with the wrench. Depending on circumstances, mainly where a reaction surface is located relative to the head of the wrench, either the in-line reaction or the offset reaction element can be used with either the hex opening in the head or the hex-to-square adapter being used to torque an element to be fastened.

The above discussed and other features and advantages of the present invention will be apparent to and understood by those of ordinary skill in the art from the following detailed description and drawings.

BRIEF DESCRIPTION OF THE DRAWINGS

Referring now to the drawings, where like elements are numbered alike in the several FIGS..

DESCRIPTION OF THE PREFERRED EMBODIMENTS

Figure 2:
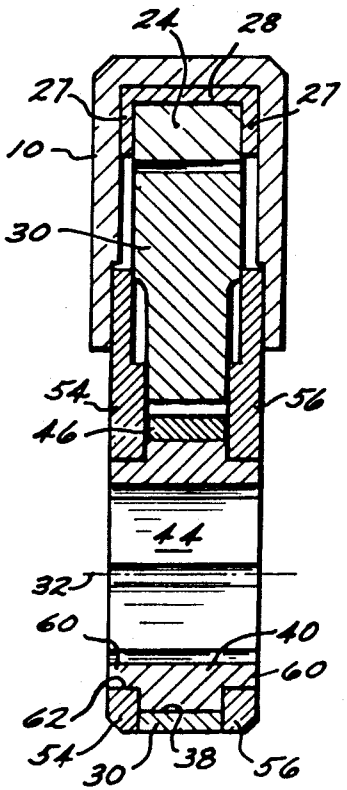
FIG. 2 is a view taken along line 2—2 of FIG. 1.

Referring to a joint consideration of FIGS. 1-5, the wrench of the present invention has a one piece body 10 which has a cylindrical Piston chamber 12 therein. As can best be seen in FIG. 4, the exterior of body 10 is cylindrical at the left end of chamber 12 and merges to a rectangular cross section about half way along the axis of chamber 12. A piston 14 is housed for movement in chamber 12, and Piston 14 has a piston rod 16 fixed thereto and extending from the right face of the piston. The left end of chamber 12 is closed by a plug 18 which has an "O" ring seal as shown. Plug 18 is screw threaded to the left end of body 10. The right end of piston rod 16 passes through a seal sleeve 20 which has an "O" seal ring a shown against rod 16. Seal sleeve 20 is press fit into the right end of chamber 12 against an annular shoulder 22 which has a circular clearance for the passage of rod 16. Supply/vent ports 11 and 13 (see FIG. 4) alternately deliver pressurized fluid to one side of piston 14 and vent the other side to drive piston 14 and rod 16 to the right for a forward stroke of the wrench and to the left for a return stroke. Of course, the operating direction of the wrench could be reversed if desired.

Piston rod 16 is cylindrical in cross section and is semispherical at its right end. The right end of rod 16 is attached by a roll pin, as shown, to a toothed rack 24 which has a semispherical recess of slightly larger radius to mate with the semispherical end of piston rod 16 and which is mounted for travel in a chamber 26 in housing 10. The movement of rack 24 in chamber 26 is guided by side rails 27 of a track 28 which is connected by screw fasteners to the upper surface of body 10.

An output lever 30 is mounted for rotary movement in the wrench about an axis 32. Output lever 30 has an arc segment of involute gear teeth 34 which mesh with the straight sided teeth 36 on rack 24 as the rack is driven to the right on a forward stroke or to the left on a return stroke of the wrench to drive output lever 30 clockwise or counterclockwise, respectively. The top of output lever 30 and the teeth 34 extend into chamber 26, while the lower part of lever 30 projects beyond housing 10.

Output lever 30 has a circular opening 38 in which a ratchet ring 40 with teeth 42 is located and is free to rotate. Although only a few of the teeth 42 are shown, it will be understood that the teeth 42 extend around the entire circumference of ring 40. Ratchet ring 40 has a hexagonal central through opening 44 which is symmetrical about axis 32 and is designed to fit over and mate with a hexagonal bolt head to be torqued. A multi-toothed pawl 46 with teeth 48 is positioned in a pocket 50 in lever 30, and pawl 46 is loaded against the ratchet teeth 42 by a spring 52 positioned between pawl 44 and the upper wall of pocket 50. The sense of the pawl teeth 48 and the ratchet teeth 42 is such that the teeth engage and the ratchet ring 40 (and hence the hexagonal opening 44), is driven clockwise with clockwise movement of lever 30 on a forward stroke of the wrench (with the pawl loading against the left wall of pocket 50); while the teeth disengage and pawl 46 is moved toward the top of pocket 50 to permit lever 30 to move counterclockwise relative to the stationary ratchet ring 40 (when engaged on a fastener) on a return stroke of the wrench.

Figure 5:
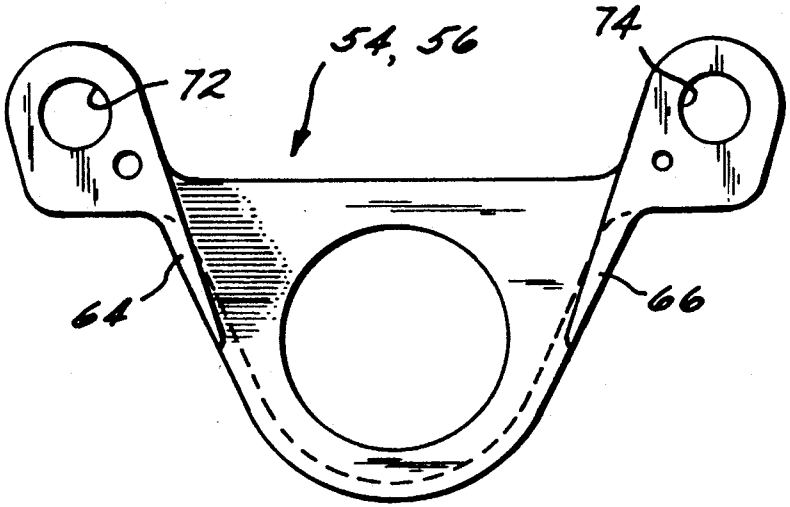
FIG. 5 is a detail of side cover plates for the wrench

Output lever 30 is retaincd in the wrench by a pair of side plates 54 and 56, one of which is shown in detail in FIG. 5. The side plates, with the lever 30, ratchet 40 and pawl 46 sandwiched between them, are held together by a pair of screw fasteners 57, 58. An annular flange 60 extends axially (with respect to axis 32) from both sides of ratchet 40, and the outer circumference of each flange 60 rides in a comparably sized circular opening 62 in each of the side plates 54, 56. Each flange 60 includes the through-passage 44. Plates 54 and 56 have inwardly projecting surfaces 64, 66 which meet when the two side plates are joined and which cooperate to define the front and back walls of a pocket in which the output lever 30 is encased within a pocket to prevent injury to an operator whose fingers might otherwise be exposed to the moving lever arm.

Figure 1:
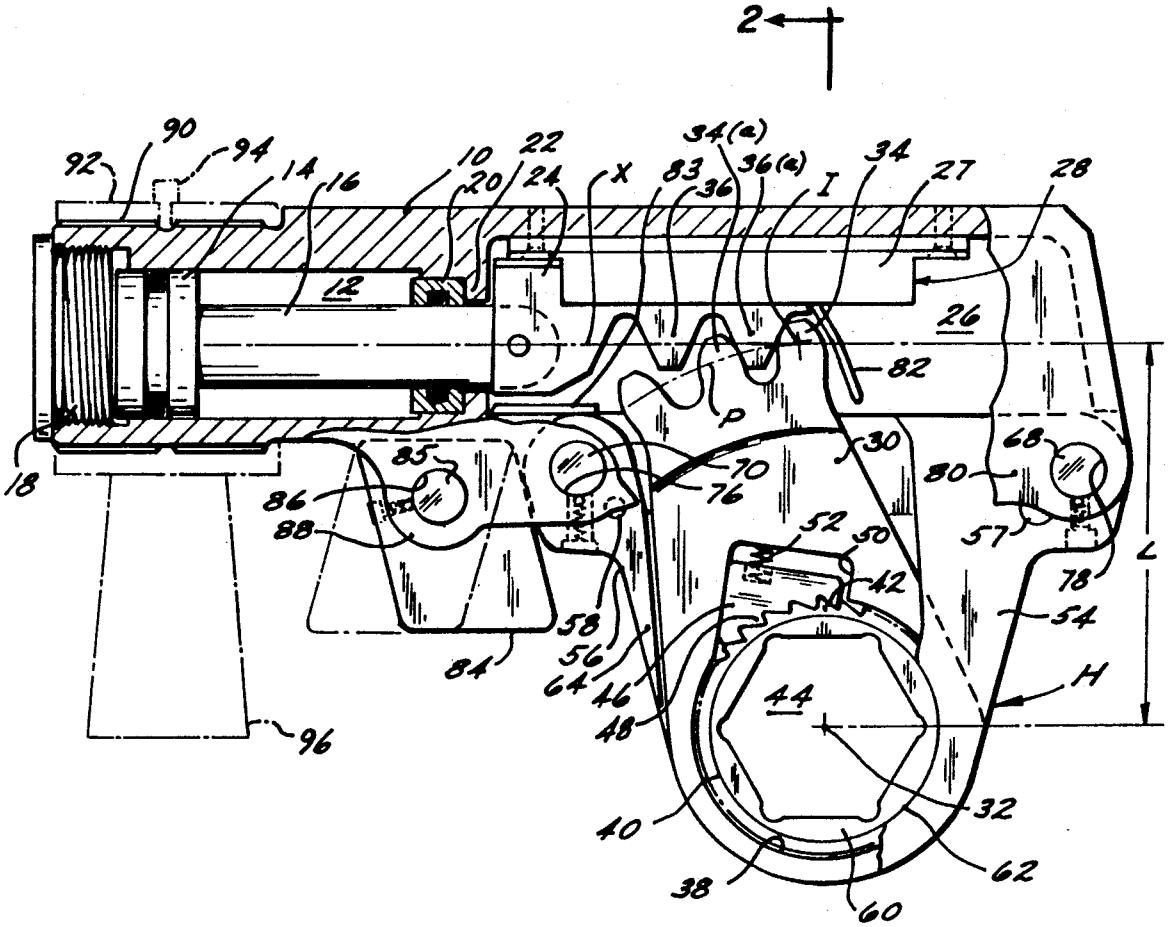
FIGS. 1 is an elevation view, partly in section, of the wrench of the invention.
Figure 4:
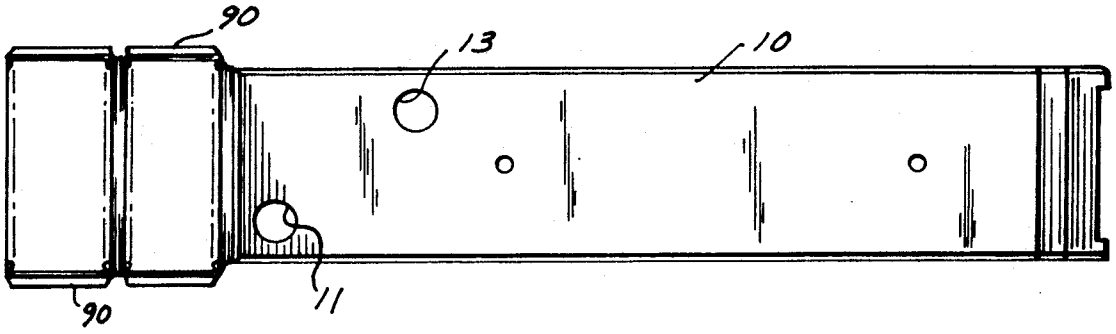
FIG. 4 is a top plan view of the body of FIG. 3 along line 4—4 of FIG. 3.
Figure 3:
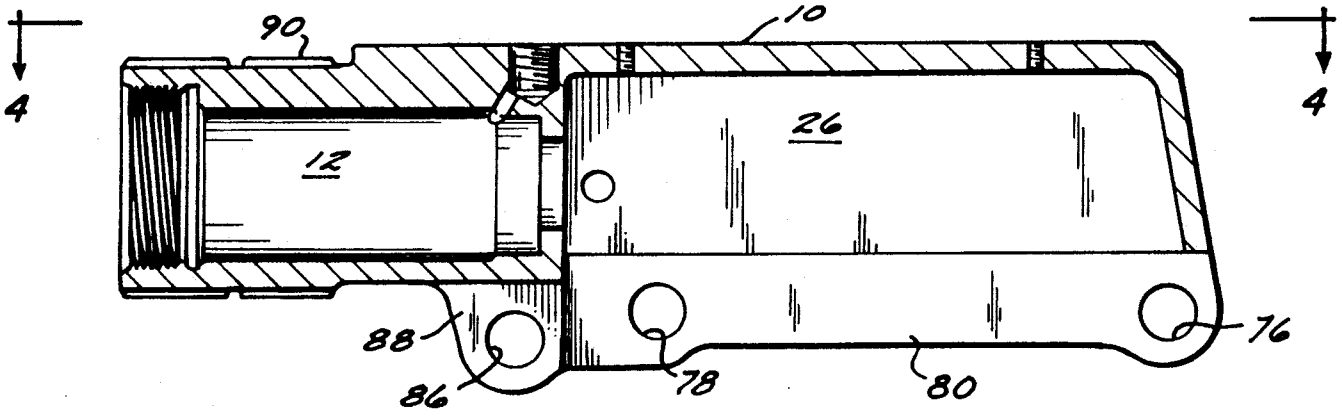
FIG. 3 is a sectional elevation view of the body of the wrench.

The structure of the lever arm 30 sandwiched between side plates 54, 56, together with the ratchet and pawl mechanism constitute a head structure H for the wrench. That head structure is assembled apart from the body of the wrench, and the head is then joined to the wrench by a pair of retaining pins 68,70 which pass through and seat in openings 72, 74 and 76, 78, in both side plates and in both sides of housing 10. Thus, as can be seen in FIGS. 1 and 3, the head is positioned between a pair of depending flanges 80 on each side of housing 10 and is held in place, i.e., connected to the wrench body, by the retaining pins 68, 70. The retaining pins are held in place by spring loaded ball detents, and the retaining pins can be removed by applying force along their axes to disconnect the head from the wrench if desired.

It is intended that the wrench of the present invention will have a plurality of heads H, each with a different sized hex opening 44. Bearing in mind that the hex opening will fit directly on the head of a bolt to be fastened, and bearing in mind that bolt head sizes (from flat to flat) will vary depending on the size of the bolt, a family of heads H will be provided with the wrench of this invention; and the hex openings in that family of heads may range, e.g., from 1" to $2\frac{3}{8}$" (from flat to opposing flat) to correspond to a range of standard bolt head sizes.

Also, the heads H may be of different lever arm lengths to vary or control the maximum output torque of the wrench. (The lever arm length L is defined as the perpendicular distance from axis 32 of the hex opening to the line of action X of the rack, the line of action X being an extension of the axis of the piston rod 16 and also being(the pitch line of the rack). By using different lever arm lengths, the output torque of the wrench can be controlled to prevent over torquing a bolt or a drive bar. For example, with a given fluid pressure P being used to drive piston 14, and with a head H, having a lever arm length of L, the wrench will generate a maximum torque level of $T_1$ ft./lbs. If that torque level $T_1$ should be higher than desired, a lower torque output of $T_2$ ft./lbs. can be obtained by using a head $H_2$ having a shorter lever arm length $L_2$. The lower torque output may be desired to avoid overloading either a bolt (because of the size or application for which the bolt is used) or a small size (e.g., 1") drive bar if a hex to square drive bar adapter is being used with the wrench.

Referring to FIG. 1, a positioning finger 82 is attached to the sloping front surface of rack 24. Positioning finger 82 is longer than the roots of the teeth 34 and 36 on the lever arm and the rack, and positioning finger 82 functions to assure proper indexing and seating of the gear teeth as shown in FIG. 1 so that all of the gear teeth will mesh in proper sequence during operation of the wrench. If an attempt were made to position lever arm 32 incorrectly relative to the rack when mounting a head H in the wrench (such as by having the lever arm rotated clockwise so that the middle tooth 34(*a*) of the lever arm was to the right side of the last rack tooth 36(*a*)), positioning finger 82 will hit the root between the lever arm teeth and prevent the lever arm and head H from being properly seated in and mounted to the wrench. It is only when the lever arm and rack are in the proper relative positions to have all of the teeth mesh in proper sequence, as shown in FIG. 1, that the positioning finger 82 permits the lever arm and head H to be properly seated in and mounted to the wrench.

A pair of guard plates 83 are screw fastened to each of the side plates 54, 56. If the head H is inserted in the wrench in the correct orientation, the guard plates 83 will be at the left as shown in FIG. 1 and will slip into a clearance space in chamber 26. However, if an attempt is made to insert the head H in an orientation flipped 180° from the correct orientation, the guard plates 83 will be on the right side and will interfere with the right side of the body 10 of the wrench to prevent seating of the head and to prevent the holes from lining up to insert pins 68, 70. This insures that the lever 30 and its gear teeth 34 are inserted properly to interact properly with the rack to apply the force at a constant lever arm length L and in a constant direction.

The wrench has an in-line reaction element 84 which is mounted to wrench body 10 by a retaining pin 85 which passes through an opening in reaction element 84 and a pair of openings 86 in spaced flanges 88 which depend from body 10. A spring loaded ball detent holds pin 85 in place. Reaction element 84 serves as a reaction element for the wrench when a grounded reaction surface is available in the "plane" of the wrench. (The body of the wrench has thickness and thus occupies more than a theoretical plane, but the term "plane" is used to refer to the space occupied by the thickness of the wrench.) That situation may exist, e.g., when the wrench is being used in its low profile mode to tighten a bolt in an array of bolts such as in a ring. With the hex opening 44 over and engaged with the head of one such bolt, reaction element 84 may butt upon against a flat surface on an adjacent bolt. Also, if the wrench is being used in an offset mode (with a hex to square drive bar adapter mounted in hex opening 44), reaction foot 84 may still be used as the reaction element if a suitable reaction surface is accessible. For example, the wrench may be used in an offset mode to tighten a bolt in a recessed location in some structure. In that situation, a reaction surface on the structure may be available in the "Plane" of the wrench against which reaction element 84 can react. It is to be noted that the position of reaction element 84 can be reversed 180° to the position shown in phantom in FIG. 1 to extend the range of the reaction element to engage a more remote surface in the "plane" of the wrench. That reversal is accomplished merely by applying sufficient force to the axis of pin 85 to remove the pin, removing element 84 from between body flanges 88, reversing element 84 by 180°, repositioning it between the flanges 88 reinserting pin 85. Reaction element 84 is a permanent attachment to wrench body 10 so that it is always available for use if a suitable surface is available against which it can react. If a suitable reaction surface is not available against which reaction element 84 can react, the wrench has provision for a second offset reaction element which can react to a remote location for reaction. To that end, a spline 90 is located around the cylindrical left and of body 10 to which an offset reaction element would be mounted. The offset reaction element has a cylindrical collar 92 with an internal spline to mate to spline 90 to mount the offset reaction element to the wrench. A set screw 94 passes through collar 90 and seats in an annular groove at the mid point of the spline to lock collar 92 to the wrench. Collar 92 also has an elongated reaction arm extending therefrom to reach to and engage a remote surface to against which it can react. Collar 92 and arm 96 are shown in phantom in FIG. 1. Arm 96 is shown in the plane of the paper, but it will be understood that collar 92 and arm 96 may be positioned at any position 360° around the wrench. If the offset reaction element is used, it would preferably be positioned so that arm 96 is parallel to axis 32. The offset reaction element will generally be used only when a reaction surface is not available for in-line reaction element 84. Therefore, the offset reaction element is not intended to be a permanent part of the wrench body.

Figure 7:
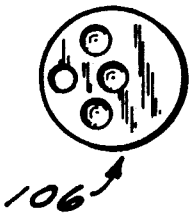
FIG. 7 shows a detail of the adapter bar of FIG. 6
Figure 6:
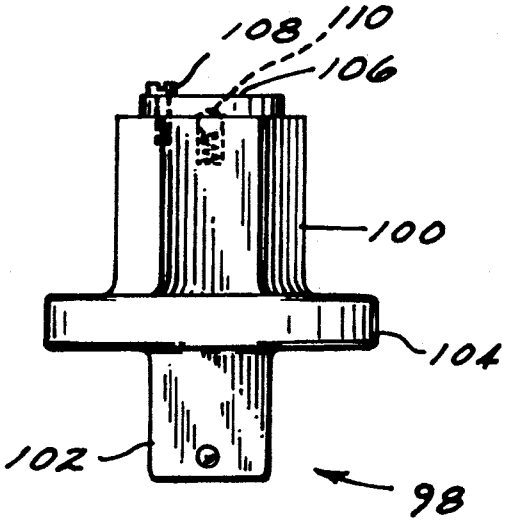
FIG. 6 shows a hex-square adapter bar for use with the wrench.

Referring to FIGS. 6 and 7, a hex-square adapter bar 98 for use with the wrench is shown. The bar 98 has a hex section 100 and a square section 102 joined by a cylindrical segment 104. The square segment has a ball detent to retain socket elements to be mounted therein. A swivel retainer plate 106 is mounted atop hex section 100 by a screw 108. Hex section 100 has a spring loaded ball detent 110 which engages any one of three semi-spherical recess in the bottom surface of retainer plate 106. Retainer plate 106 serves to retain the hex to square adapter in the wrench. Retainer plate 106 is first positioned with the detent 110 engaging the middle of the three recesses in the retainer plate, and the hex segment 100 is mounted in hex opening 44 in the wrench, with the plate extending just beyond flange 60. The retainer plate is then shifted about screw 108 so that the ball detent 110 engages on one or the other of the outermost of the recesses in the retainer plate, whereby the retainer plate overlaps the flange 60 to prevent the adapter 98 from disengaging from the wrench.

In its operation the wrench of the present invention has the important advantage that the length L of the lever arm remains effectively constant throughout the operating stroke of the wrench and that the point, direction and angle at which the actuating force is applied to the lever arm also remains constant. The length L of the lever arm is defined as the perpendicular distance from pitch line X of the rack to axis 32 of hex opening 44 (which will coincide with the axis of the bolt being torqued). It is important to note that rack pitch line X is tangent to the pitchline P of the lever arm gear teeth 34 at a point I on line 1 and that line 1, which is perpendicular to X, includes both that point of tangency I and axis 32; and that a line perpendicular to the tangent to the contact surfaces between the gear and rack teeth will pass through I. That insures that the direction and angle of application of force from the rack to the lever arm is effectively always at a 90° angle to line 1, and it insures that the length L of the lever arm remains constant throughout the operation of the wrench. Thus, the rack and gear mechanism of the present invention achieve the important advantages of constant lever arm length and constant angle and direction of force application, thus giving this wrench a higher degree of operating accuracy than prior art wrenches of this type.

Figure 9:
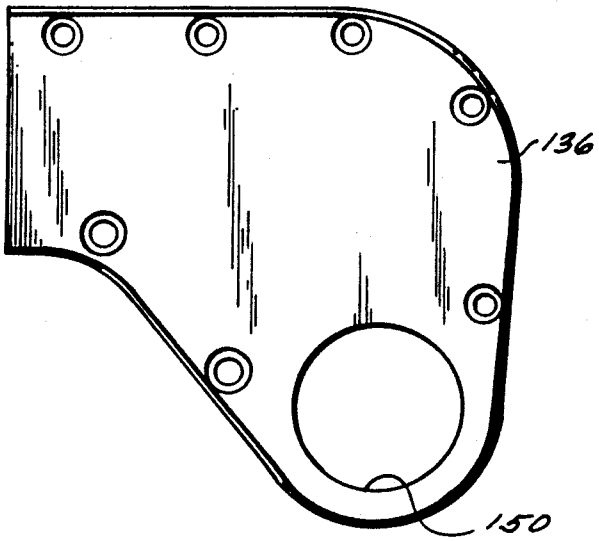
FIG. 9 shows a detail of FIG. 8.
Figure 8:
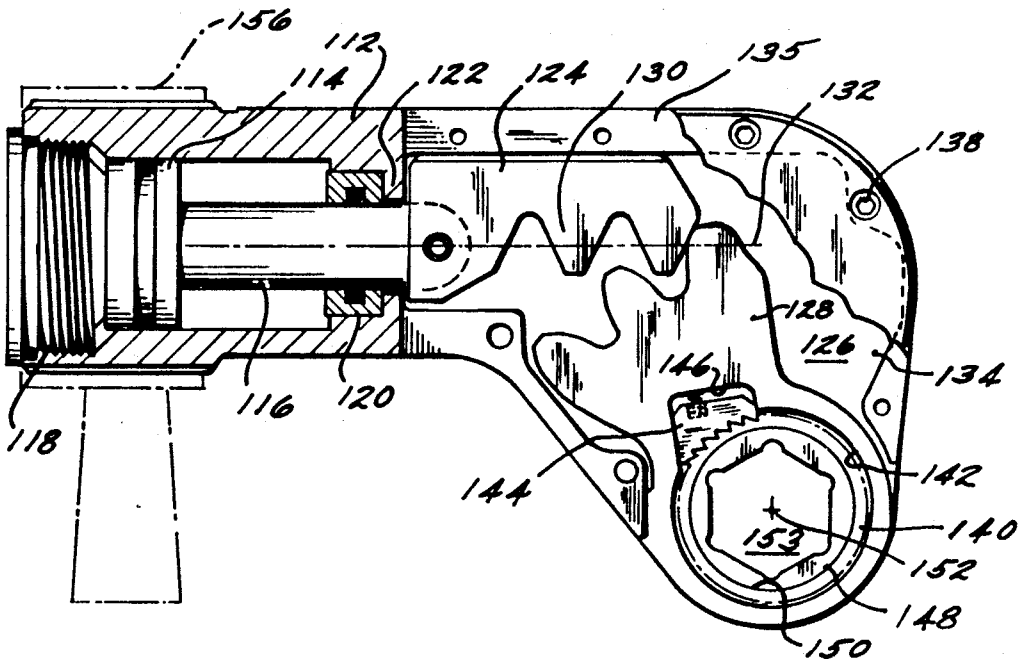
FIG. 8 is view similar to FIG. 1 showing a second embodiment.

Referring now to FIGS. 8 and 9, a second embodiment of the rack and gear lever arm drive of the present invention is shown. The embodiment of FIGS. 8 and 9 is intended to be a small hand held wrench (about 8" long by about 4" high), and it has a single permanent operating head. The one piece body 112 has a piston 114, a piston rod 116, an end plug 118, a seal sleeve 112, a shoulder 122 and a rack 124 as in the embodiment of FIGS. 1 and 2, but with sizes being different to be consistent with the size of this second embodiment. This wrench has a chamber 126 in which the rack slides and drives an output lever 128 by meshing of rack teeth 130 with lever teeth 132. Lever teeth 132 are a segment of a gear. Chamber 126 is formed between a rear wall 134 which is an integral part of wrench body 112 and a front cover plate 136 which is secured to the rear wall by a series of screws 138 around the periphery of the rear wall and cover plate. The lever 128 has a ratchet ring 140 in a circular opening 142 and a spring loaded pawl 144 in a pocket 146. Ratchet ring 140 has an annular flange 148 which extends on the front side of the wrench through circular opening 150 in front cover plate 136 and rearwardly through a similar circular opening in rear wall 134. Thus, the output lever and the ratchet are rotatably retained between the front plate and the rear wall for rotation about axis 152 when the wrench is assembled. Flange 148 has a hexagonal through passage 153 which receives a hex to square bar adapter such as adapter 98 with a retainer 106 as shown in FIGS. 6 and 7. Since this wrench is intended to be used primarily in an offset mode, it has an offset reaction element in the form of spline 154 on body 112 which mates with a splined collar 156 and from which extends a reaction arm 158. The collar and reaction arm are like collar 92 and reaction arm 96 of FIG. 1.

The wrench of the embodiment of FIGS. 8 and 9 does not contemplate interchangeable heads in the sense that the head of the FIG. 1 embodiment can be detached and replaced. However, if desired, the lever arm 128 could be replaced by one or more similar lever arms having the same lever arm length L but different sized ratchets and hex openings. The wrench of FIGS. 8 and 9 has the rack and gear drive mechanism of the FIG. 1 embodiment, so it has the advantageous features of constant lever arm length L and constant direction, angle and point of application of the actuating force.

While both wrench embodiments have been described as having hex openings in the wrench heads, it will be understood that any desired polygonal opening can be employed.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A wrench for applying torque to a fastener element, including:

a housing;

toothed rack means in said housing for transmitting an actuating force, said toothed rack means having a pitch line X;

actuating means in said housing for delivering an actuating force to said toothed rack means;

lever arm means for delivering an output from said wrench to a fastener, said lever arm means having a toothed gear segment which meshes with teeth of said toothed rack means, said toothed gear segment having a pitch line P;

output ratchet means carried by said lever arm means at a location spaced form said gear segment; said output ratchet means having an axis of rotation about which said lever arm moves;

said lever arm means having an effectively constant lever arm length L extending substantially along a line from said axis of rotation to said pitch line X substantially at the point of tangency of said pitch line X and said pitch line P and being at substantially an angle of 90° to the said pitch line X, whereby the actuating force is delivered to said lever arm means at substantially 90° to said line; and reaction means connected to said housing for providing a reaction member for the wrench.

2. A wrench as in claim 1 including:

detachable head means connected to said housing, said lever arm means and said ratchet means being carried by said detachable head; and first positioning means attached to said toothed rack means to effect proper seating and indexing of said tooth gear segment relative to said toothed rack means upon connection of a detachable head means to said housing.

3. A wrench as in claim 2 including:

second positioning means attached to said detachable head means to effect proper orientation of said detachable head means upon mounting thereof to said housing.

4. A wrench as in claim 2 wherein said detachable head means includes:

first and second side plates fastened together;

said lever arm means and said ratchet means being sandwiched between said side plates;

each of said plates having a circular opening to receive flanged extensions from opposite sides of said ratchet means;

a polygonal opening through said ratchet means and said flanges; and pin means for attaching said head means to said housing.

5. A wrench as in claim 4, including:

polygonal to square adapter means for mounting in said polygonal opening, said adapter means having a polygonal section and a square section extending along a common axis; and retainer means attached to said end of said polygonal section to hold said adapter means in said polygonal opening.

6. A wrench as in claim 5 wherein:

said retainer means includes a plate rotatably attached to said polygonal section and moveable between positions which overlap one of said flanges or align with said polygonal opening.

7. A wrench as in claim 1 including:

guide means in said housing to guide the movement of said toothed rack means.

8. A fluid operated wrench for applying torque to a fastener element, including:

a housing;

a fluid operated piston mounted in said housing for reciprocating movement in response to fluid pressure delivered to said piston;

a piston rod extending from one end of said piston, said piston rod having an axis;

a toothed rack attached to said piston rod, said toothed rack having a pitch line X along the axis of said piston rod;

an output lever arm supported by said housing for delivering an output from said wrench to a fastener, said lever arm having a toothed gear segment which meshes with teeth of said toothed rack, said toothed gear segment having a pitch line P;

an output ratchet mounted in said lever arm at a location spaced from said gear segment, said output ratchet having an axis of rotation about which said lever arm moves;

said lever arm having an effectively constant lever arm length L extending substantially along a line from said axis of rotation to said pitch line X at substantially the point of tangency of said pitch line X and said pitch line P and being at substantially an angle of 90° to the axis of said piston rod, whereby the actuating force is delivered to said lever arm means at substantially 90° to said line;

reaction means connected to said housing for providing a reaction member for said wrench in line with the housing of said wrench; and mounting means on said wrench for connecting to said wrench an offset reaction element for reaction offset with respect to the housing of said wrench.

9. A wrench as in claim 8 including:

detachable head means connected to said housing, said lever arm means and said ratchet means being carried by said detachable head; and first positioning element attached to said toothed rack means to effect proper seating and indexing of said tooth gear segment relative to said toothed rack means upon connection of a detachable head means to said housing.

10. A wrench as in claim 9 including:

a second positioning element attached to said detachable head means to effect proper orientation of said detachable head upon mounting thereof to said housing.

11. A wrench as in claim 9 wherein said detachable head includes:

first and second side plates fastened together;

said lever arm and said ratchet being sandwiched between said side plates;

each of said plates having a circular opening to receive flanged extensions from opposite sides of said ratchet;

a polygonal opening through said ratchet means and said flanges; and pin means for attaching said head means to said housing.

12. A wrench as in claim 11, including:

polygonal to square adapter means for mounting in said polygonal opening, said adapter means having a polygonal section and a square section extending along a common axis; and retainer means attached to said end of said polygonal section to hold said adapter means in said polygonal opening.

13. A wrench as in claim 12 wherein:

said retainer means includes a plate rotatably attached to said polygonal section and moveable between positions which overlap one of said flanges or align with said polygonal opening.

14. A wrench as in claim 8 including:

a track in said housing to guide the movement of said toothed rack means.

15. A wrench for applying torque to a fastener element, including:

a housing;

toothed rack means in said housing for transmitting an actuating force;

actuating means in said housing for delivering an actuating force to said toothed rack means;

lever arm means for delivering an output from said wrench to a fastener, said lever arm means having a toothed gear segment which meshes with teeth of said toothed rack means, and said lever arm means having an effectively constant lever arm length;

output ratchet means carried by said lever arm means at a location spaced from said gear segment; said output ratchet means having an axis of rotation about which said lever arm moves; and reaction means connected to said housing for providing a reaction member for the wrench.

16. A wrench as in claim 15 including:

detachable head means connected to said housing, said lever arm means and said ratchet means being carried by said detachable head; and first positioning means attached to said toothed rack means to effect proper seating and indexing of said tooth gear segment relative to said toothed rack means upon connecting of a detachable head means to said housing.

17. A wrench as in claim 16 including:

second positioning means attached to said detachable head means to effect proper orientation of said detachable head means upon mounting thereof to said housing.

18. A wrench as in claim 16 wherein said detachable head means includes:

first and second side plates fastened together;

said lever arm means and said ratchet means being sandwiched between said side plates;

each of said plates having a circular opening to receive flanged extensions from opposite sides of said ratchet means;

a polygonal opening through said ratchet means and said flanges; and pin means for attaching said head means to said housing.

19. A wrench as in claim 18, including:

polygonal to square adapter means for mounting in said polygonal opening, said adapter means having a polygonal section and a square section extending along a common axis; and retainer means attached to said end of said polygonal section to hold said adapter means in said polygonal opening.

20. A wrench as in claim 19 wherein:

said retainer means includes a plate rotatably attached to said polygonal section and moveable between positions which overlap one of said flanges or align with said polygonal opening.

21. A wrench as in claim 15 including:

guide means in said housing to guide the movement of said toothed rack means.

22. A fluid operated wrench for applying torque to a fastener element, including:

a housing;

a fluid operated piston mounted in said housing for reciprocating movement in response to fluid pressure delivered to said piston;

a piston rod extending from one end of said piston, said piston rod having an axis;

a toothed rack attached to said piston rod;

an output lever arm supported by said housing for delivering an output from said wrench to a fastener, said lever arm having a toothed gear segment which meshes with teeth of said toothed rack, and said lever arm having an effectively constant lever arm length;

an output ratchet mounted in said lever arm at a location spaced from said gear segment, said output ratchet having an axis of rotation about which said lever arm moves;

reaction means connected to said housing for providing a reaction member for said wrench in line with the housing of said wrench; and mounting means on said wrench for connecting to said wrench an offset reaction element for reaction offset with respect to the housing of said wrench.

23. A wrench as in claim 22 including:

detachable head means connected to sad housing, said lever arm means said said ratchet means being carried by said detachable head; and first positioning element attached to said toothed rack means to effect proper seating and indexing of said tooth gear segment relative to said toothed rack means upon connection of a detachable head means to said housing.

24. A wrench as in claim 23 including:

a second positioning element attached to said detachable head means to effect proper orientation of said detachable head upon mounting thereof to said housing.

25. A wrench as in claim 23 wherein said detachable head includes:

first and second side plates fastened together;

said lever arm and said ratchet being sandwiched between said side plates;

each of said plates having a circular opening to receive flanged extensions from opposite sides of said ratchet;

a polygonal opening through said ratchet means and said flanges; and pin means for attaching said head means to said housing.

26. A wrench as in claim 25, including:

polygonal to square adapter means for mounting in said polygonal opening, said adapter means having a polygonal section and a square section extending along a common axis; and retainer means attached to said end of said polygonal section to hold said adapter means in said polygonal opening.

27. A wrench as in claim 26 wherein:

said retainer means includes a plate rotatably attached to said polygonal section and moveable between positions which overlap one of said flanges or align with said polygonal opening.

28. A wrench as in claim 22 including:

a track in said housing to guide the movement of said toothed rack means.

* * * * *